United States Patent [19]

Powell

[11] 4,422,279

[45] Dec. 27, 1983

[54] METHOD FOR CONSTRUCTING A REINFORCED FOUNDATION

[76] Inventor: John M. Powell, 5169 Alum Rock Ave., San Jose, Calif. 95127

[21] Appl. No.: 299,800

[22] Filed: Sep. 4, 1981

[51] Int. Cl.[3] ..... E04B 1/00

[52] U.S. Cl. ..... 52/741; 52/127.3; 52/293; 52/300; 52/370; 52/699

[58] Field of Search ..... 52/293, 295, 370, 300, 52/699, 703, 712, 715, 741, 742, 127.3; 264/30

[56] References Cited

U.S. PATENT DOCUMENTS

| | | | |
|---|---|---|---|
| 1,662,645 | 3/1928 | Lampert | 52/370 |
| 1,850,462 | 3/1932 | Kinninger | 52/699 |
| 2,903,879 | 9/1959 | Williams | 52/293 |
| 3,145,505 | 8/1964 | Cornelius | 52/712 |
| 3,422,585 | 1/1969 | Dismakes | 52/295 |
| 3,471,988 | 10/1969 | Allen | 52/293 |
| 3,729,882 | 5/1973 | Allen | 52/300 |
| 3,750,360 | 8/1973 | Kinston | 52/295 |
| 3,998,026 | 12/1976 | Allen | 52/295 |

*Primary Examiner*—Henry E. Raduazo
*Attorney, Agent, or Firm*—Robert W. Dilts

[57] ABSTRACT

A method for constructing a reinforced foundation including locating and supporting a reinforcing rod at a preselected position in the foundation and securing a mudsill to the foundation without affecting the location of the supporting rod.

7 Claims, 9 Drawing Figures

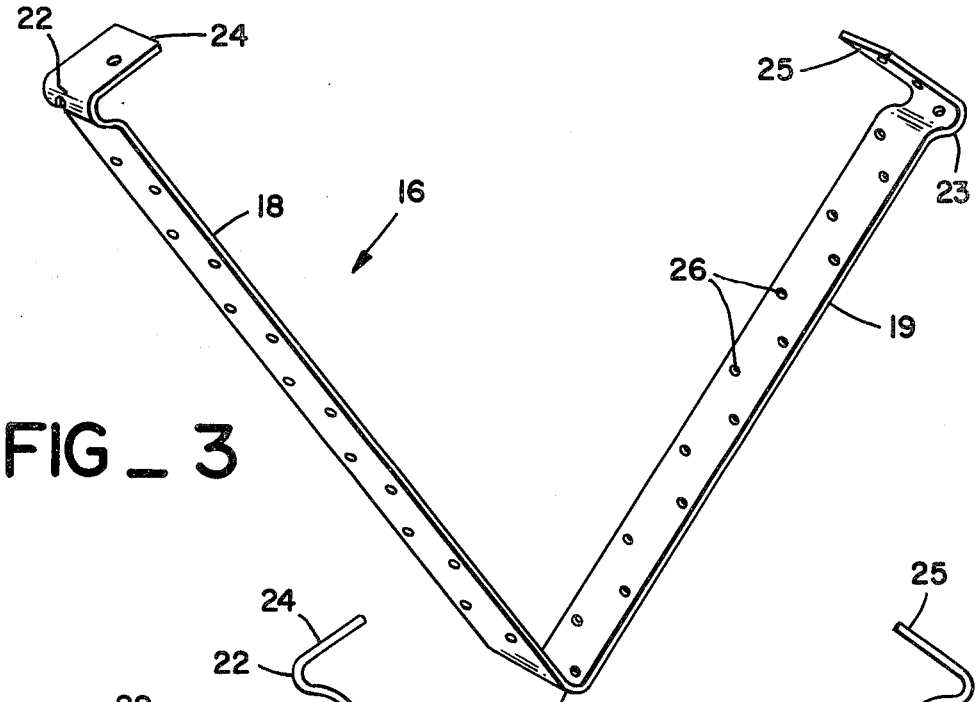
FIG_3
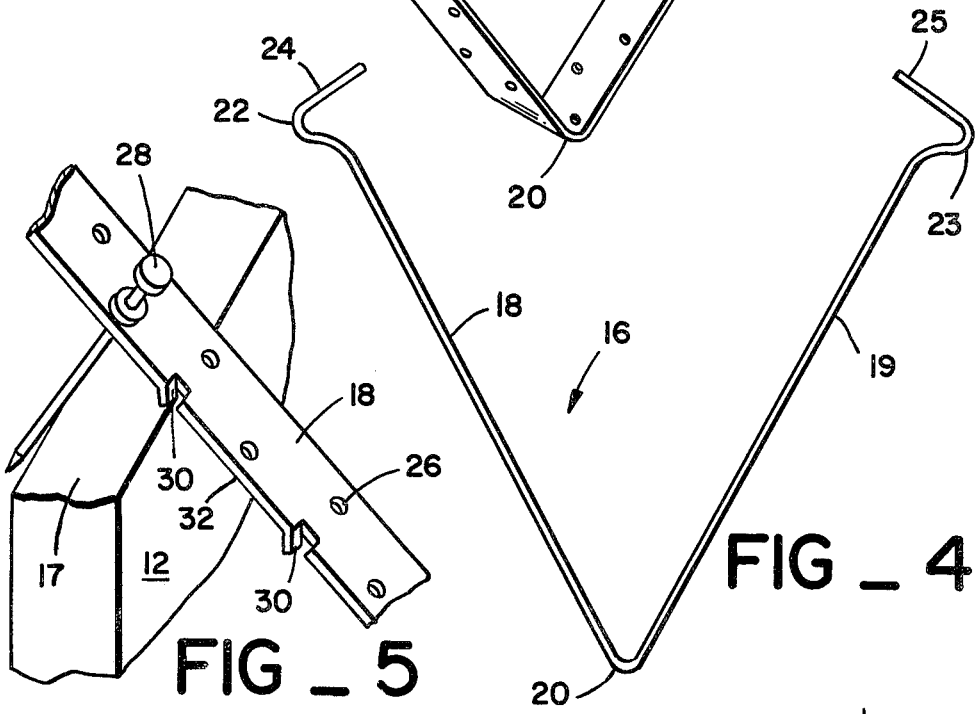
FIG_4
FIG_5
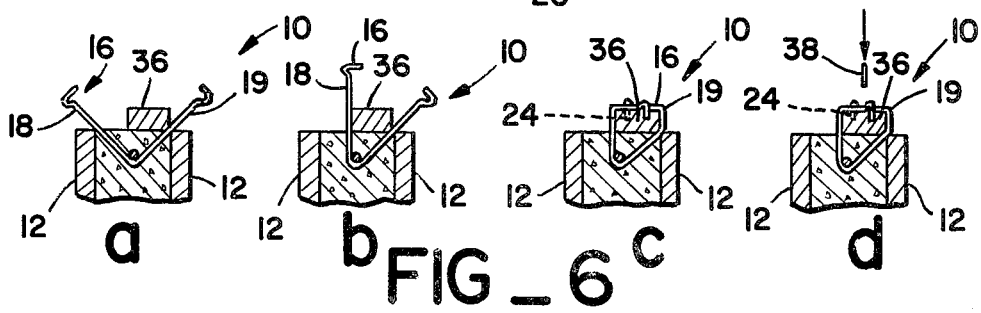
FIG_6

METHOD FOR CONSTRUCTING A REINFORCED FOUNDATION

BACKGROUND OF THE INVENTION

This invention relates to foundations for wall structures and the like and, more particularly, to a method for locating and supporting a reinforcing rod at a preselected position in the foundation for a wall structure and for securing a mudsill to the foundation.

In constructing curbs, walls, foundations and the like of concrete or similar initially fluid materials which subsequently harden into the desired structure, it is common to fabricate a form consisting of spaced sides or panels defining the exterior side surfaces of the desired structure. Frequently it is necessary to secure reinforcing steel or rods intermediate the form sides at certain predetermined depths and lateral locations relative to the side panels to attain the desired strength within the concrete structure. It is important that the reinforcing rods be held in the particular preselected locations as the concrete is being poured so that the force exerted thereon by the flowing concrete does not shift the rods and, thus, weaken the structure.

In the prior art, the reinforcing rods were located and held within the form by various means fabricated on site with whatever materials were available, such as wire and stakes. This is a time consuming and inexact method at best and often results in failure to accomplish the desired reinforcement if not actual weakening of the foundation.

Moreover, building codes and good construction practice dictate the use of connectors to tie the wall structure to the foundation in geographical areas subject to earthquakes, hurricanes, or high wind loads. One solution to this problem is the setting of threaded bolts in the concrete foundation and inserting the free ends of the upright bolts through holes drilled in the wood mudsill. Threaded nuts bearing against washers hold the mudsill to the foundation.

Alternate solutions to this problem prefabricated sheet metal mudsill tiedowns such as disclosed in U.S. Pat. No. 3,889,441, issued to E. A. Fortine on June 17, 1975. Tiedowns of this type are generally attached to the mudsill prior to pouring of the concrete or inserted while the concrete is still very flowable to prevent bending of the long narrow anchor strips. Others are of a construction such that they may be inserted into relatively dry mixed concrete without bending.

However, neither of the above methods of securing a mudsill to a foundation, either the use of threaded bolts or one of the prefabricated metal straps, both of which are relatively costly, addresses the associated problem of positioning and securing reinforcing steel in the foundation intermediate the form panels. Further, depending upon the required depth of the rod in the concrete and its lateral position relative to the form sides, the insertion of threaded bolts or prefabricated tiedown members therein may cause undesirable shifting of the rod.

The foregoing illustrates the limitations of the known prior art. Thus, it is apparent that it would be advantageous to provide an alternative to the prior art.

SUMMARY OF THE INVENTION

According to the present invention, the problems pertaining to the known prior art, as set forth above, are advantageously avoided. This is accomplished by providing a method for locating and supporting a reinforcing rod at a preselected position in a foundation and for securing a mudsill to the foundation which includes the steps of fixing a pair of form sides at a preselected spaced position with respect to each other, supporting a plurality of manually bendable elongated members in spaced relationship on the tops of the form sides, bending each said elongated members to define a pair of substantially rectilinear legs extending at an angle to each other, placing at least one reinforcing rod between the legs of the angled members, pouring concrete to a preselected depth intermediate the form sides, installing the mudsill on top of the poured concrete, and bending the legs of the angle members around the mudsill.

BRIEF DESCRIPTION OF THE DRAWINGS

The foregoing and other objects and features of the subject invention will be more fully understood from a reading of the following detailed description of preferred embodiments thereof in conjunction with the attached drawings wherein:

FIG. 3 is a perspective view of an elongated member in accordance with a preferred embodiment of the present invention;

FIG. 4 is a side elevational view of the strap of FIG. 3;

FIG. 5 is a fragmentary perspective view of a portion of an elongated member according to an alternate embodiment of the invention shown enlarged to better illustrate the elements thereof; and FIGS. *6a–6d* are reduced cross-sectional views of FIG. 2 showing the sequential steps of securing the mudsill to the concrete foundation according to a preferred embodiment of the invention.

DESCRIPTION OF THE PREFERRED EMBODIMENTS

Figure 1:
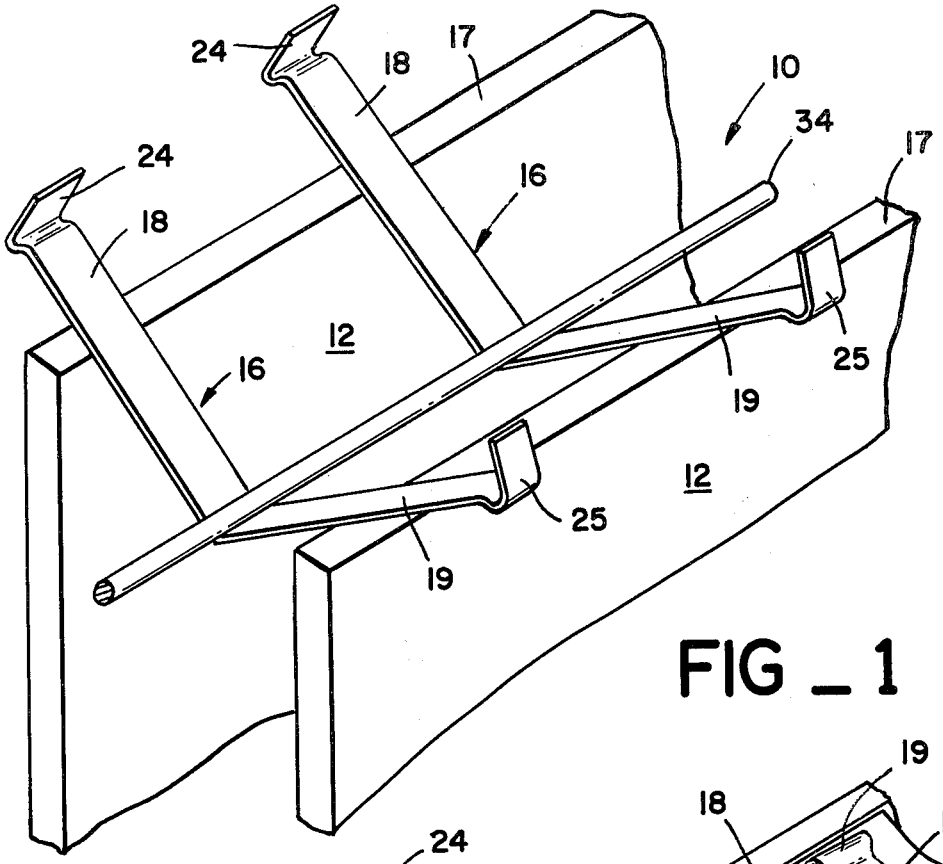
FIG. 1 is a perspective view showing a pair of form sides having a reinforcing rod supported thereon by two elongated members in accordance with the present invention.

Referring now to the drawings, an open top form assembly embodying the present invention is illustrated generally by the numeral 10, and, as best shown in FIG. 1, includes a pair of form sides or panels 12 fixed at a preselected spaced position with respect to each other to define the sides of a foundation 14 wall of a given height, length and thickness (FIG. 2) formed from concrete or a similarly initially fluid material which subsequently hardens into the desired structure. The form assembly further includes a plurality of elongated members or straps 16 having a length substantially greater than the foundation thickness which are supported in a substantially parallel, preselected spaced relationship across the tops 17 of the form sides. While for purposes of illustration only two such straps are shown, it is to be understood that, depending upon the length of the form assembly and the weight of the steel to be supported thereby, any number of straps may be used as dictated by sound construction practice.

Referring now to FIGS. 3–5, preferred embodiments of the elongated members or straps 16 are illustrated in greater detail. Each member 16 is of a generally V-shaped configuration having a pair of oppositely disposed generally rectilinear legs 18,19 joined at a manually bendable angle 20. Each of the legs 18,19 may further include an end having a convexly inwardly facing bight 22,23 formed therein respectively, each of which terminates in a tab 24,25 respectively extending inwardly in a direction substantially normal to its associated leg. The entire member 16 is preferably constructed of a generally malleable material, for example sheet metal, and may have a plurality of holes 26 formed therein and spaced at regular intervals along the length thereof which are each adapted to receive a nail 28 or the like (FIG. 5) for positioning the member 16 on the tops 17 of the form sides 12. Alternatively, each strap may be positioned on the form sides 12 by a plurality of outwardly extending tabs 30 formed at measured intervals along one edge 32 of the strap. The nails or tabs assist in securing the desired placement and spacing of the reinforcing rod 34 prior to the concrete pour.

Referring again to FIGS. 1 and 2, after the form panels 12 are set, the straps 18 are centrally bent to a position intermediate and below the tops 17 of the form panels at any desired angle for a given spacing of the form panels to locate a reinforcing rod 34 at the desired depth and lateral position relative thereto. The rod is then placed along the center portions 20 of the straps, and the concrete is poured to the desired depth intermediate the form sides to form the foundation 14.

Figure 2:
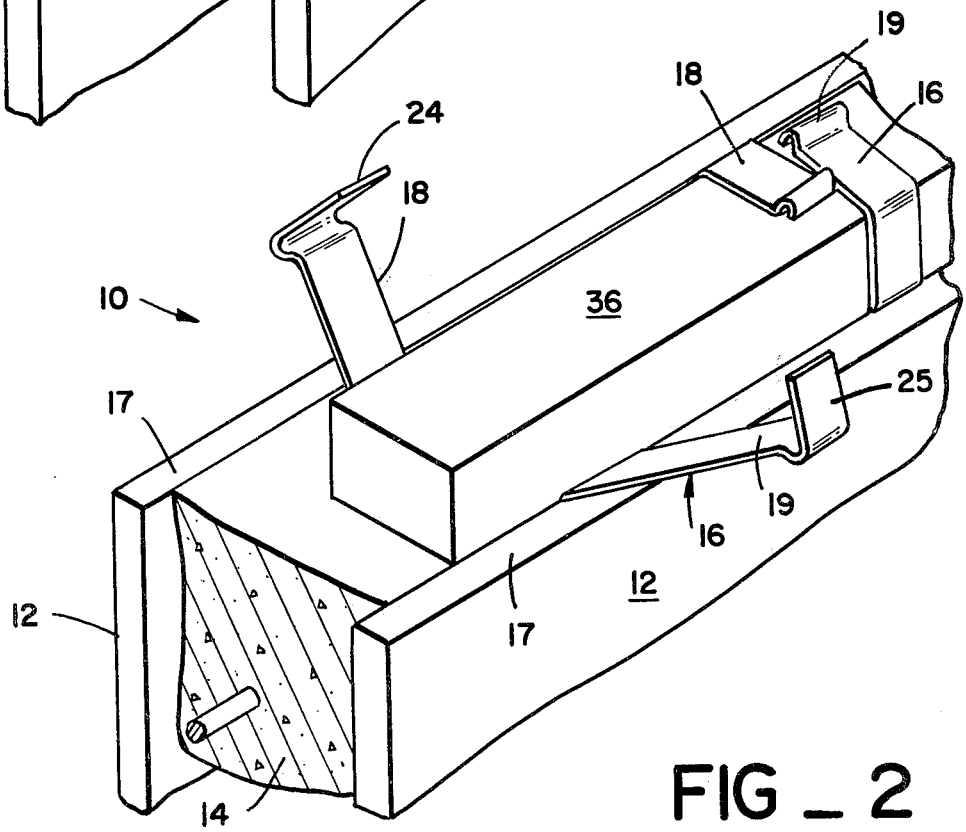
FIG. 2 is a perspective view of the form sides of FIG. 1 having a concrete foundation poured therebetween and a mudsill partially secured thereto.

As best viewed in FIGS. 2 and **6*a*–6*d*, a mudsill 36 is installed on top of the poured concrete foundation between the legs 18 and 19 of the straps 16**. For illustrative purposes only a 6 inch mudsill is shown, but it is to be understood that mudsills of other widths, such as a 4 inch, an 8 inch or a full 12 inch width mudsill could be used as well.

After the mudsill 36 has been installed on the foundation 14, and before the concrete has set, on leg (18 for example) of each of the straps 16, according to the preferred embodiment of the invention is bent up against the side of the mudsill 36 so that the mudsill 36 is forced against the other leg 19, but the location of the reinforcing bar 34 is not affected, as illustrated in FIG. **6*b*. Referring to FIG. 6*c*, after the concrete has set, the legs 18 and 19 of each of the straps are then bent around the mudsill to position the end portion of one leg 19 adjacent the end portion of the opposing leg 18 of the same strap. Each of the tabs 24,25 associated with the respective legs 18,19 may be driven adjacent one another into the mudsill, or, alternatively could be fashioned to penetrate the strap material, thus enabling the straps to overlap and to be secured without nails. Furthermore, as illustrated in FIG. 6*d*, a staple could be installed over the straps if additional strength is required. Alternatively, the end portion of the legs 18 and 19** could be bound to each other by a clip or buckle member.

Thus, it can be seen that a reinforcing rod located and supported in accordance with the present invention will remain in its desired location relative to the form panels both during the concrete pouring operation and also during the anchoring of a mudsill to the foundation. Moreover, the mudsill will exhibit strength and stability which is far superior to that exhibited by those secured by prior art methods due to the full withdrawal resistance in any direction of the embedment element.

Other aspects, objects, and advantages of this invention can be obtained from the study of the drawings, the disclosure, and the appended claims.

I claim:

1. The method of constructing a reinforced foundation comprising the steps of:

(a) fabricating an open top form for a foundation wall of given length, height and thickness;

(b) fabricating a plurality of manually bendable elongated members having a length substantially greater than said given foundation wall thickness;

(c) bending each of said plurality of elongated members to define a pair of substantially rectilinear legs extending at an angle to each other with a spacing between the free ends of said rectilinear legs greater than said given foundation wall thickness;

(d) placing said plurality of elongated members in spaced relation to each other across said open top of said form with said rectilinear legs extending into said open top of said form;

(e) placing an elongated reinforcing rod within said form with its long dimension extending along said given length in supported relation between said legs of each of said plurality of elongated members at a height less than said given height;

(f) filling said form with concrete to said given height whereby said reinforcing rod and adjacent portions of said legs of each of said plurality of elongated members are embedded in said concrete; and (g) before said concrete has set, bending the one of said legs of each of said plurality of elongated members which is on the same given side of said given length up through said concrete to a given spacing from said other of said legs of each of said plurality of elongated members.

2. The method of claim 1 including the steps of fabricating said elongated members of sheet metal; and fabricating a plurality of holes formed at spaced regular intervals along the length of each of said plurality of elongated members.

3. The method of claim 1 including the steps of fabricating said elongated members of sheet metal; and fabricating a plurality of outwardly extending tabs formed at measured intervals along one edge of said plurality of elongated members.

4. The method of claim 1 including the step of prebending each of said plurality of elongated members to a preselected angle after fabrication thereof.

5. The method of claim 1 including the steps of installing an elongated mudsill on said concrete, said mudsill having a bottom surface with a transverse dimension substantially equal to said given spacing of said legs of said plurality of elongated members from each other with the elongated dimension of said mudsill extending along said given length between said legs of said plurality of elongated members;

bending said legs of each of said elongated members around said mudsill after said concrete has set; and rigidly fixing the ends of said legs of said elongated members with respect to each other.

6. The method of claim 5 further including the steps of bending the ends of said legs of each of said plurality of elongated members inwardly in a direction substantially normal to said legs; and embedding said ends of said legs in said mudsill.

7. The method of claims 5 including the step of installing retaining means on said legs of each of said plurality of elongated members.

* * * * *